US010443522B2

(12) United States Patent
Park

(10) Patent No.: US 10,443,522 B2
(45) Date of Patent: Oct. 15, 2019

(54) ENGINE IDLING CONTROL SYSTEM OF CONSTRUCTION MACHINE

(71) Applicant: VOLVO CONSTRUCTION EQUIPMENT AB, Eskilstuna (SE)

(72) Inventor: Seong-Cheol Park, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 15/561,033

(22) PCT Filed: Mar. 23, 2015

(86) PCT No.: PCT/KR2015/002824
§ 371 (c)(1),
(2) Date: Sep. 23, 2017

(87) PCT Pub. No.: WO2016/153089
PCT Pub. Date: Sep. 29, 2016

(65) Prior Publication Data

US 2018/0058355 A1 Mar. 1, 2018

(51) Int. Cl.
*F02D 41/00* (2006.01)
*F02D 41/08* (2006.01)
(Continued)

(52) U.S. Cl.
CPC ..... *F02D 41/08* (2013.01); *E02F 9/02* (2013.01); *E02F 9/2066* (2013.01);
(Continued)

(58) Field of Classification Search
CPC ..... F02D 41/08; E02F 9/02; E02F 9/2004; F15B 13/0424
See application file for complete search history.

(56) References Cited

U.S. PATENT DOCUMENTS 5,941,923 A * 8/1999 Fischer ..... B60W 10/02 477/154
8,606,442 B2 * 12/2013 Kang ..... B60K 6/485 701/22
(Continued)

FOREIGN PATENT DOCUMENTS

JP H08121205 A 5/1996
KR 1020110012036 A 2/2011
(Continued)

OTHER PUBLICATIONS

International Search Report (dated Nov. 30, 2015) for corresponding International App. PCT/KR2015/002824.

*Primary Examiner* — Hieu T Vo
*Assistant Examiner* — Sherman D Manley
(74) *Attorney, Agent, or Firm* — Sage Patent Group

(57) ABSTRACT

An engine idling control method for a construction machine includes setting, by an E-ECU, an initial engine RPM as a starting mode (S mode) by receiving a signal from a V-ECU at the time of an engine startup; receiving, by the E-ECU, a first instruction via an engine speed control switch in a state other than an automatic idle mode; activating the automatic idle mode when the first instruction is not input to a machine during a certain time period, and setting the engine RPM as the starting mode (S mode); deactivating the automatic idle mode when a second instruction is input to the machine via the engine speed control switch while the automatic idle mode is activated; and calculating, by the V-ECU, an actual torque required for a pump for starting the machine according to the second instruction when the automatic idle mode is deactivated, and sending the actual torque to the E-ECU.

8 Claims, 3 Drawing Sheets

(51) Int. Cl.

| | |
|---|---|
| ***E02F 9/02*** | (2006.01) |
| ***E02F 9/20*** | (2006.01) |
| ***F02D 41/06*** | (2006.01) |
| ***F15B 13/042*** | (2006.01) |
| *E02F 9/22* | (2006.01) |

(52) U.S. Cl.
CPC ..... *F02D 41/0007* (2013.01); *F02D 41/062* (2013.01); *F15B 13/0424* (2013.01); *E02F 9/2004* (2013.01); *E02F 9/2285* (2013.01); *F02D 2200/101* (2013.01)

(56) References Cited

U.S. PATENT DOCUMENTS

| | | | | |
|---|---|---|---|---|
| 9,222,488 | B2 * | 12/2015 | Kang | B60K 6/48 |
| 9,399,856 | B2 * | 7/2016 | Fujishima | B60W 20/00 |
| 9,650,761 | B2 * | 5/2017 | Magaki | E02F 9/2075 |
| 10,066,573 | B2 * | 9/2018 | Thomas | F02D 41/065 |
| 2013/0275011 | A1 * | 10/2013 | Ota | E02F 9/2075 701/50 |
| 2017/0283227 | A1 * | 10/2017 | Turnbull | B66F 9/07563 |

FOREIGN PATENT DOCUMENTS

| | | | |
|---|---|---|---|
| KR | 1020120069789 | A | 6/2012 |
| KR | 1020130057615 | A | 6/2013 |
| KR | 1020140080868 | A | 7/2014 |

* cited by examiner

[FIG. 1]
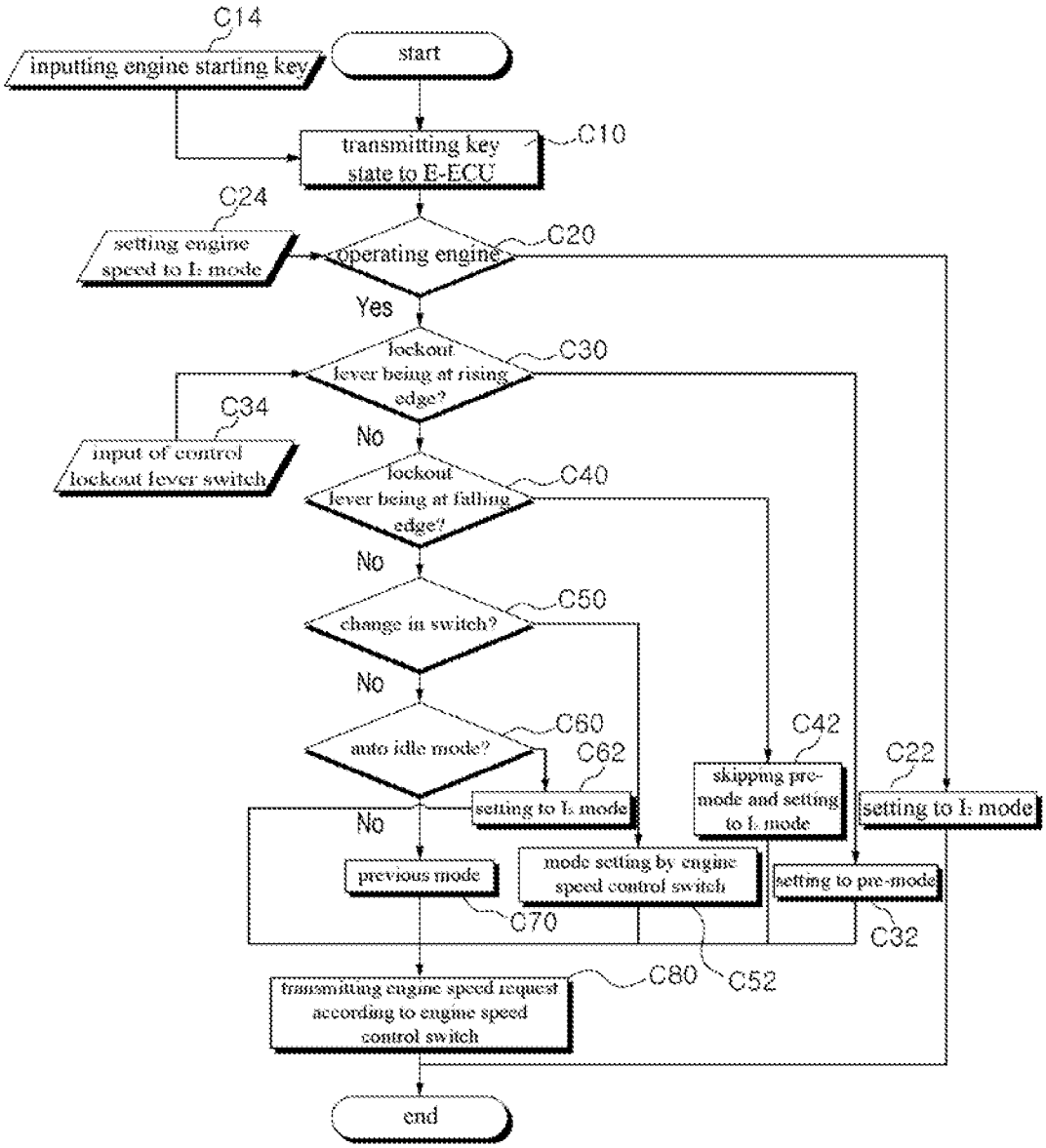

[FIG. 2]
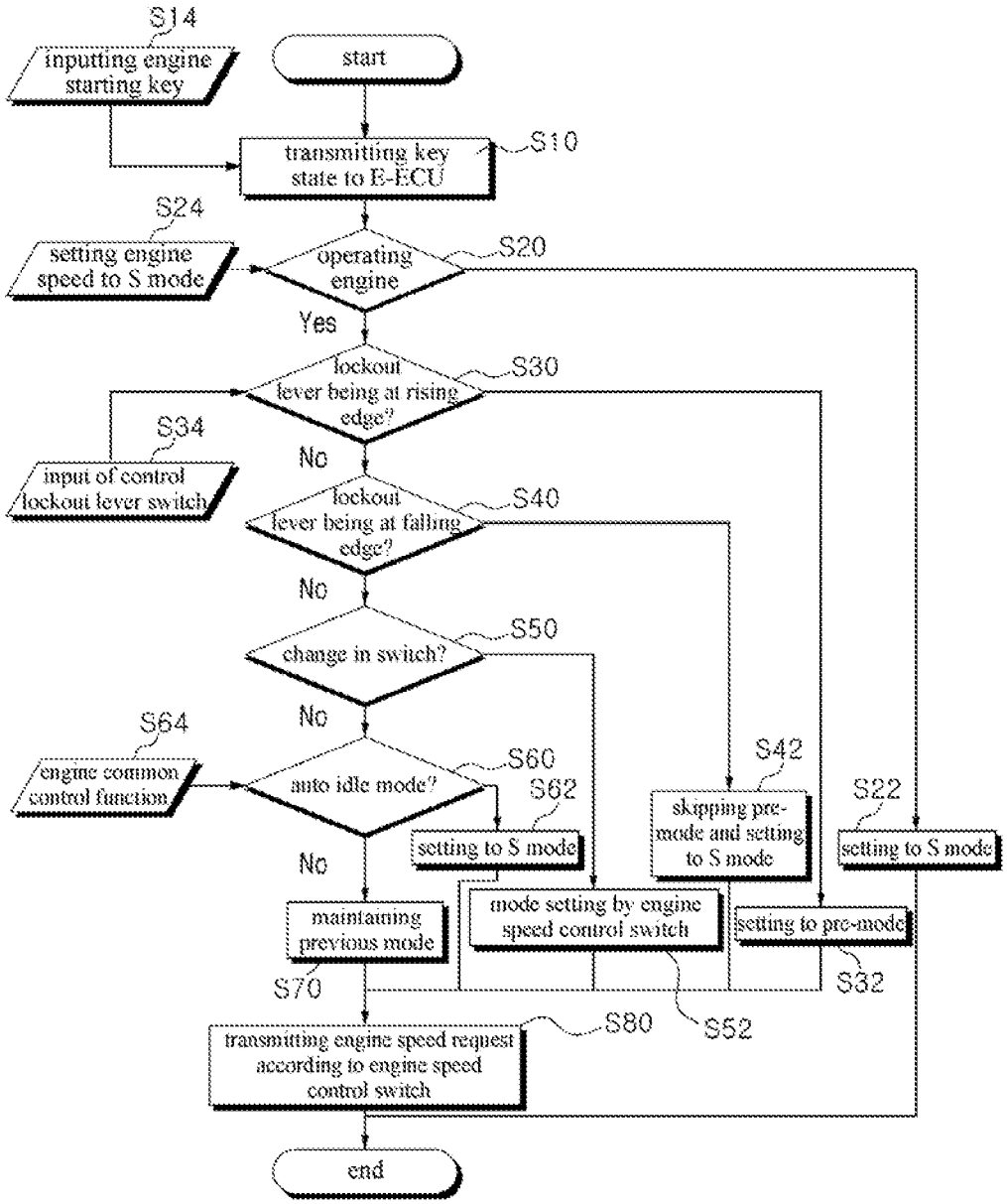

[FIG. 3]
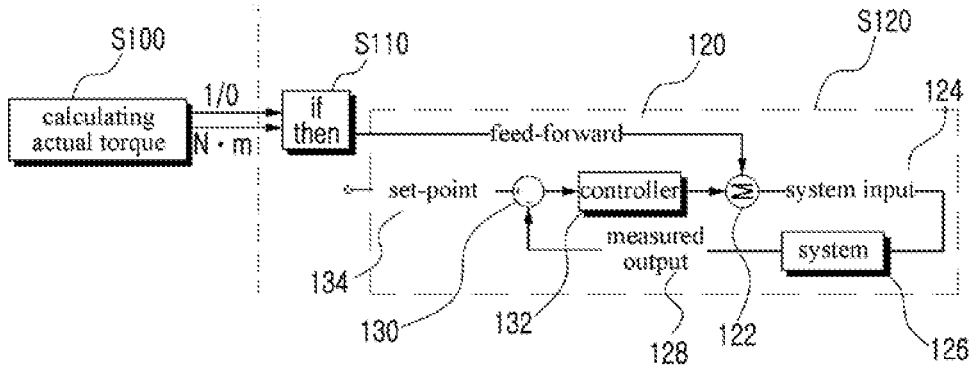
[FIG. 4]
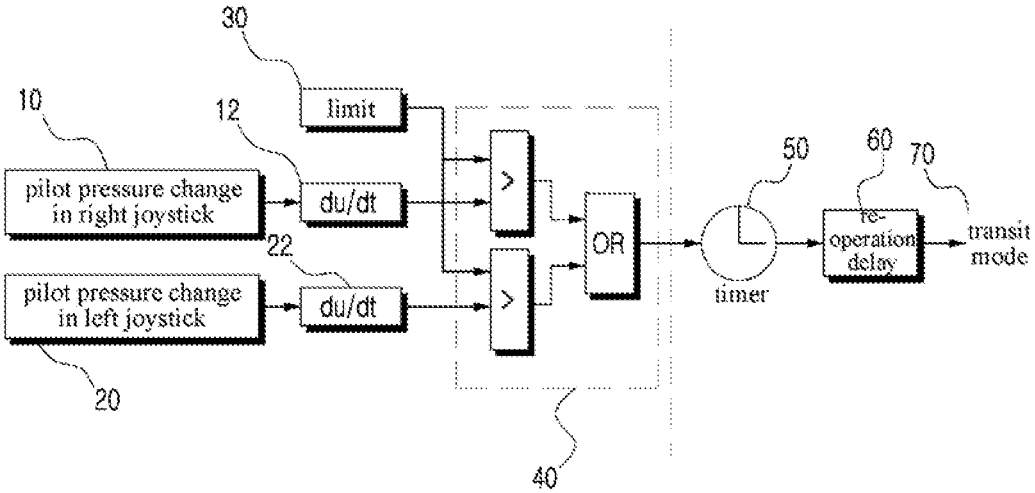

ENGINE IDLING CONTROL SYSTEM OF CONSTRUCTION MACHINE

BACKGROUND AND SUMMARY

The present disclosure relates to a construction machine. More particularly, the present disclosure relates to an engine idling control system for an excavator.

Idling refers to a state in which a vehicle or a machine is stopped while an engine is operating. Exhaust emitted in such a state by the vehicle or the machine pollutes the atmosphere since the amount of carbon monoxide and the amount of nitrogen oxide produced are higher than when the vehicle or the machine is operated in a state of acceleration, constant speed, deceleration, etc. Thus, it may become a factor in lowering fuel efficiency. Accordingly, techniques have been developed to lower the environmental pollution level, and reduce fuel consumption by lowering the engine RPM per minute during such an idling state.

Until now, in an engine idling system applied to an excavator, an idling engine RPM is set slightly high for engine starting according to a height of the bucket, and for a rapid response according to a load. As a result of investigating driver usage patterns by RPM, a low idling RPM comprises about 20%, and there are situations where the engine is maintained at the high idling RPM without operation, whereby fuel is consumed unnecessarily.

In an engine idling system applied to a conventional construction machine, an idling engine RPM is set relatively high to ensure a fast response when a load is applied. Accordingly, an engine RPM may be controlled to rapidly respond to a load required for a work while decreasing fuel consumption and also lowering an engine RPM in an idling state.

According to one aspect of the present disclosure, there is provided an engine idling control system capable of setting the lowest idling engine RPM required for maintaining a vehicle operation as the lowest idling RPM, and controlling the engine RPM to recover to a conventional idling RPM required for rapidly responding when a work mode is activated by a lock lever switch that activates the work mode. In addition, when a machine is not used for a certain time period, the engine idling control system sets the machine to enter an auto idle mode, and controls the machine to operate in the lowest idling RPM according to a condition.

When a load required for a work is applied to an engine while the machine is a state of the lowest idling RPM, the time for the engine to reach the required RPM may delay the work. In other words, a response for the same may be delayed. Accordingly, in order to compensate such a delay, an E-ECU (an engine controlling electronic control unit (ECU)) receives in advance a signal that represents a torque value calculated by a V-ECU (a vehicle controlling electronic control unit (ECU)), and controls the engine to prepare an RPM required for the work. Thus, an engine RPM drop caused by the delayed response, or a response time is reduced so that work performance of the machine may not be affected.

An engine idling control system according to the present disclosure may decrease fuel consumption in an idling state by lowering an engine RPM maintained when a construction machine is not working, and by lowering an RPM in an auto idle mode more than a conventional RPM technique. In addition, an engine response in a low RPM may be compensated by maintaining the engine RPM in a low state in an idling state and by introducing an engine transient mode. Thus, an engine RPM drop or a response time may be reduced.

DESCRIPTION OF DRAWINGS

FIG. 1 is a flowchart showing an engine idling control system for a construction machine according to a conventional technique.

FIG. 2 is a flowchart showing an engine idling control system for a construction machine according to an embodiment of the present disclosure.

FIG. 3 is a flowchart showing a feed-forward method used in an engine common control function of the construction machine according to the embodiment of the present disclosure.

FIG. 4 is a flowchart showing an entry condition of an engine transient mode of the construction machine according to the embodiment of the present disclosure.

DETAILED DESCRIPTION

Hereinafter, the present invention will be described with reference to the accompanying drawings.

The matters defined in the description, such as the detailed construction and elements, are nothing but specific details provided to assist those of ordinary skill in the art in a comprehensive understanding of the invention, and the present invention is not limited to the embodiments disclosed hereinafter.

In order to definitely describe the present invention, a portion having no relevance to the description will be omitted, and throughout the specification, like elements are designated by like reference numerals.

In the specification and the claims, when a portion includes an element, it is meant to include other elements, but not exclude the other elements unless otherwise specially stated herein.

FIG. 1 is a flowchart showing an engine idling control system for a construction machine according to a conventional technique.

The engine idling control system according to the conventional technique controls an engine RPM in two modes in an idling state. The two modes are respectively an I1 mode and an I2 mode. The I1 mode is an idling engine RPM, and has a range from about 1000 RPM to about 1100 RPM. The I2 mode is the lowest idling engine RPM, and has a range from about 800 RPM to about 950 RPM.

Referring to the flowchart of FIG. 1, when an engine of a construction machine is started in step C14, a key state is transmitted to an E-ECU (engine controlling ECU) in, step C10, and the E-ECU operates the engine in step C20. Herein, in step C22, the E-ECU sets an engine speed to the I2 mode (about 800 RPM~950 RPM) when the engine is started.

Then, a control lockout lever is introduced as a factor changing the engine speed. The control lockout lever is called as a lockout lever, and is a kind of a safety lever. When the lockout lever is positioned at a falling edge, a machine enters into a state similar to vehicle parking. When the lockout lever is positioned at a rising edge, the machine enters to a work mode.

When the lockout lever of the machine is input to be positioned at the rising edge in step C30, in step C32, the E-ECU controls the engine speed to enter into a pre-mode (PreMod) since the machine is switched to the work mode. The pre-mode (PreMod) is a mode in which an engine speed may be changed by an engine speed control switch, and an RPM of the pre-mode is predefined to a specific RPM. Next, when a required engine speed is input by the engine speed control switch, an engine speed request is transmitted to the E-ECU in order to output the corresponding engine speed.

When the lockout lever is positioned at a falling edge, the machine enters to a state similar to vehicle parking. When the lockout lever is positioned at the falling edge, the machine skips the pre-mode (PreMod) and sets the engine speed to the I2 mode.

Then, the machine controls the engine speed according to a change of the engine speed control switch in steps C50 and C52, and transmits an engine speed request according to the change of the engine speed control switch in step C80.

When them is no change in the engine speed control switch, in other words, there is no input to the engine speed control switch, the machine enters into an auto idling state in step C60. In the auto idling state, the engine speed is set to the I1 mode (about 1000 RPM~1100 RPM) in step C62.

When the machine does not enter into an auto idle mode, the engine speed is maintained in a previous mode in step C70. Then, the machine receives an input of the engine speed control switch and transmits the engine speed request in step C80.

In the conventional technique, when a load is applied in the auto idle mode, in other words, when an input is applied by the engine speed control switch, in order to rapidly respond to the load, the engine speed is controlled to maintain a relatively high RPM.

FIG. 2 is a flowchart showing an engine idling control system for a construction machine according to an embodiment of the present disclosure.

First, in the engine idling control system according to the present disclosure, when an engine start key is input in step S14, an E-ECU receives a signal from a V-ECU in step S10, operates an engine in step S20, and sets an initial engine RPM to a starting mode (S mode) in step S22. The starting mode (S mode) is a calibrated possible lowest engine RPM, and has a range from about 500 RPM to about 800 RPM.

After, whether or not a control lockout lever switch is input, is detected in step S34, and when a lockout lever of an machine is input to be positioned at a rising edge in step S30, the E-ECU controls the engine speed to enter into a pre-mode (PreMode) in step S32 since the machine is switched to a work mode. The pre-mode is a mode in which an engine speed may be changed by an engine speed control switch, and an RPM of the pre-mode is predefined to a specific RPM. Then, when a required engine speed is input by the engine speed control switch, an engine speed request is transmitted to the E-ECU in order to output the corresponding engine speed.

When the lockout lever is positioned at a falling edge, the machine enters into a state similar to vehicle parking in step S40. When the lockout lever is positioned at the falling edge, in step S42, the machine skips the pre-mode (PreMode) and sets the engine speed to the S mode (about 500 RPM~800 RPM).

After, in steps S50 and S52, the machine controls the engine speed according to a change of the engine speed control switch, and transmits an engine speed request according to the change of the engine speed control switch in step S80.

In other words, when the E-ECU receives an input of a first instruction via the engine speed control switch when the machine is not in the auto idle mode in step S50, the E-ECU sets the engine RPM according to the input first instructionin step S52.

The E-ECU receives the first instruction input via the engine control speed switch when the engine speed is not in the auto idle mode. However, when the first instruction is not input to the machine for a certain time period, the auto idle mode is activated in step S60, and the E-ECU sets the engine RPM to the starting mode (S mode) in step S62. Herein, the S mode is set to about 500 RPM~800 RPM, preferably, about 600 RPM.

In step S64, an engine common control function controls the engine to rapidly respond when an input is applied by the engine speed control switch in the auto idle mode. For example, when a second instruction is input to the machine via the engine speed control switch when the auto idle mode is activated, the auto idle mode is deactivated, and the V-ECU calculates an actual torque required for a pump so that the machine operates according to the second instruction when the auto idle mode is deactivated, and transmits the calculated actual torque to the E-ECU. Herein, when an excessive load is applied to a current RPM of the engine, the machine enters into a transient mode by the engine common control function to respond to an unexpected load. The engine common control function will be described below in detail When the machine does not enter into the auto idle mode, the engine speed is maintained in a previous mode in step S70. After, the machine transmits an engine speed request by receiving an input from the engine speed control switch in step S80.

In other words, when the first instruction is not input to the machine for a certain time period and the auto idle mode is not activated, in step S70, the E-ECU controls the engine RPM to maintain a mode that is previously set (previous mode).

An engine speed control system according to the present disclosure may decrease fuel consumed in an idling state since the system is designed to maintain a lower RPM in an auto idle mode more than an RPM of the conventional technique. However, when the system is designed to just maintain the RPM engine to be low, and a sudden load is applied to the machine, in other words, when a driver suddenly tries to perform work, a response of the machine may be delayed due to the low engine RPM. Thus, the engine speed control system according to the present disclosure has been solved such a response problem by introducing an engine common control function. Hereinafter, the engine coil non control function will be described in detail with references to FIGS. 3 and 4.

FIG. 3 is a flowchart showing a feed-forward method used in an engine common control function of the construction machine according to the embodiment of the present disclosure.

The engine common control function includes a step of calculating, by the E-ECU, a torque change required by an engine by using a feed-forward method based on an actual torque that is input by the V-ECU.

The V-ECU may calculate a torque that is actually required for work (actual torque) based on a pump pressure. The actual torque may be calculated by using the below formula.

$$P*Q=Nm*\text{rpm},\ T=k*P*Q/n(T\text{: kgfm},\ P\text{: kgf/cm2},\ n\text{: 1 pm})$$

P is a value of a pump pressure detected by a pressure sensor installed in the machine, and Q is a parameter calculated in the below condition, 1. When a calculated RPM is lower than an allowed RPM in a load condition (pressure) that is currently measured, Q is set to discharge all required flow rates.

2. A condition opposite to the number 1 (RPM limit), in other words, when the calculated RPM is larger than the allowed RPM in the load condition (pressure) that is currently measured, Q is set to limit discharging of the flow rate.

The V-ECU transmits the calculated actual torque to an engine management system (EMS) by using true or false. The engine management system refers to a part that operates the engine, and which includes the E-ECU. When the actual torque is input, the engine management system processes as true, and when the actual torque is not input, the engine management system processes as false. Herein, a unit of the torque is Nm in general.

When the actual torque is input, the engine management system calculates how much of engine speed is required by using a feed-forward 120 method. First, changes of input actual torques are added up 122, and a torque input to the engine is input to the system by using a communication block. The torque input to the engine may be expressed as a system input 124, In the engine management system, a final engine torque value (measured output, 128) is calculated based on the input pump pressure and the torque input to the engine, and whether or not to raise an engine output is calculated 130 by comparing the calculated final engine torque value with a set-point 134. The calculated value is input to a controller 132. Herein, the set-point is an arbitrary value set in the machine, and generally means a torque value.

In the engine idling control system according to the present disclosure, when the machine is not used for a certain time period, an auto idling function is activated and the engine enters into an S mode. When a work machine starts to operate, the auto idling function is deactivated and the engine enters into a pre-mode (PreMode) from the S mode. Herein, in order to respond to a sudden load in advance, an engine transient mode is provided. The engine transient mode may be called as a transient mode (Transient Mode or Trans Mode) for short.

The engine transient mode is operated as below. When the auto idling function is deactivated, at the same time, the V-ECU calculates an actual torque that is required for operating the work machine by a pump. In order to respond to a sudden load in advance, the E-ECU receives the calculated actual torque value, and raises a boost pressure by using a turbo charger before the pump physically operates in a flywheel of the actual engine.

FIG. 4 is a flowchart showing an entry condition of the engine transient mode of the construction machine according to the embodiment of the present disclosure. The embodiment disclosed in FIG. 4 may be applied to an excavator including a right joystick and a left joystick.

First, the V-ECU detects a first flow rate variation 12 according to a pilot pressure change 10 when a right joystick is manipulated, and a second flow rate variation 22 according to a pilot pressure change 20 when a left joystick is manipulated.

Then, the V-ECU determines whether or not at least one of the first flow rate variation and the second flow rate variation exceeds a preset limit 30. When at least one of the first flow rate variation and the second flow rate variation exceeds the preset limit 30, it may mean that a rapid torque change is immediately required, thus an engine transient mode is required.

When at least one of the first flow rate variation 12 and the second flow rate variation 22 exceeds the preset limit 30, the E-ECU detects whether or not other manipulation is input within a predetermined certain time period by using a timer 50. In other words, the E-ECU waits for whether or not a driver inputs other instructions within a certain time period (re-operation delay, 60). When other manipulations are not input within the predetermined certain time period, the E-ECU controls the engine to enter into the transient mode 70 (Transient Mode).

The embodiments as described above are provided only for an example to describe system thereof. Accordingly, it is to be understood that various equivalent modifications and variations of the embodiments can be made by a person having an ordinary skill in the art without departing from the spirit and scope of the present invention.

The invention claimed is:

1. An engine idling control method for a construction machine, the method comprising:

setting, by an E-ECU, an initial engine RPM as a starting mode (S mode) by receiving a signal from a V-ECU when an engine starts;

receiving, by the E-ECU, a first instruction via an engine speed control switch in a state other than automatic idle mode;

activating the automatic idle mode when the first instruction is not input to the machine for a certain time period, and setting, by the E-ECU, the engine RPM as the starting mode (S mode);

deactivating the automatic idle mode when a second instruction is input to the machine via the engine speed control switch while the automatic idle mode is activated; and calculating, by the V-ECU, an actual torque required for a pump for operating the machine according to the second instruction when the automatic idle mode is deactivated, and sending the calculated actual torque to the E-ECU, the method, further comprising: after setting, by the E-ECU, the initial engine RPM as the starting mode (S mode) by receiving the signal from V-ECU when the engine starts, setting, by the E-ECU, the engine RPM as a pre-mode (PreMode) when a lockout lever is input to be at a rising edge, wherein the pre-mode is a mode in which engine speed is adapted to be changed by the engine speed control switch, and wherein, when the lockout lever is at the rising edge, the machine enters a work mode.

2. The method of claim 1, further comprising: setting, by the E-ECU, the engine RPM as a pre-mode (PreMode) when the lockout lever is input to be at the rising edge, after setting, by the E-ECU, the initial engine RPM as the starting mode (S mode) by receiving the signal from the V-ECU at the time of an engine startup.

3. The method of claim 2, further comprising: skipping, by the E-ECU, the pre-mode (PreMode), and setting the engine RPM as the starting mode (S mode) when the lockout lever is input to be at a falling edge, rather than the rising edge, after setting, by the E-ECU, the initial engine RPM as the starting mode (S mode) by receiving the signal from the V-ECU.

4. The method of claim 3, further comprising: setting, by the E-ECU, the engine RPM according to the first instruction, when the E-ECU receives the first instruction via the engine speed control switch in a state other than the automatic idle mode.

5. The method of claim 1, further comprising: controlling, by the E-ECU, the engine RPM to maintain a mode that is previously set (previous mode), when the first instruction is not input to the machine for the certain time period, and the automatic idle mode is not activated.

6. The method of claim 1, the method further comprising: controlling a torque change of the engine by using a feed-forward method based on the actual torque input from the V-ECU.

7. The method of claim 6, further comprising:

detecting, by the V-ECU, a first flow rate variation according to a change in a pilot pressure when a right joystick is manipulated;

detecting, by the V-ECU, a second flow rate variation according to the change in a pilot pressure when a left joystick is manipulated;

determining, by the V-ECU whether or not at least one of the first flow rate variation and the second flow rate variation exceeds a preset limit;

detecting, by the E-ECU, whether or not another manipulation is input within a certain time period when at least one of the first flow rate variation and the second flow rate variation exceeds the preset limit; and controlling, by the E-ECU, the engine to enter into a transient mode when another manipulation is not input within the certain time period.

8. The method of claim 7, further comprising: preparing, by the E-ECU, to a rapid change in a load in advance by raising a boost pressure via a turbo charger based on the calculated actual torque before a pump being operated in a flywheel of the engine, when the engine enters into the transient mode.

* * * * *